US005848630A

United States Patent [19]

Manzo

[11] Patent Number: 5,848,630

[45] Date of Patent: Dec. 15, 1998

[54] TANDEM SECURITY GARAGE DOOR

[75] Inventor: Mario E. Manzo, Antelope, Calif.

[73] Assignee: Partnership of Mario E. Manzo, Stan Parrish and Mark Hurst, Antelope, Calif.

[21] Appl. No.: 8,958

[22] Filed: Jan. 20, 1998

[51] Int. Cl.[6] ..... E06B 3/48

[52] U.S. Cl. ..... 160/113; 160/201

[58] Field of Search ..... 160/201, 113, 160/229.1, 236, 232, 118, 119

[56] References Cited

U.S. PATENT DOCUMENTS

| | | | |
|---|---|---|---|
| 2,072,092 | 3/1937 | Blodgett . | |
| 3,021,896 | 2/1962 | Buono et al. . | |
| 3,103,967 | 9/1963 | Gaschen . | |
| 3,126,944 | 3/1964 | Kempinski . | |
| 3,938,577 | 2/1976 | Richards . | |
| 4,081,018 | 3/1978 | Szwartz . | |
| 4,231,412 | 11/1980 | Nowak . | |
| 4,356,668 | 11/1982 | Wagner | 160/113 X |
| 4,653,566 | 3/1987 | Miale . | |
| 4,673,019 | 6/1987 | Silverthorne . | |
| 4,712,598 | 12/1987 | Bonacci . | |
| 4,846,241 | 7/1989 | Chomka . | |
| 5,050,660 | 9/1991 | Bleichwehl et al. . | |
| 5,427,169 | 6/1995 | Saulters . | |
| 5,611,382 | 3/1997 | Sferra | 160/113 |

*Primary Examiner*—David M. Purol
*Attorney, Agent, or Firm*—Heisler & Associates

[57] ABSTRACT

A secondary security garage door is provided that is attached to and operates behind a primary garage door. The security door is made up of multiple panels composed of an outside frame supporting a wire mesh material. The security door rides along a separate guide rail adjacent to the primary garage door guide rail When assembled and installed, these panels form a barrier that prevents unwanted intruders access to the garage, or the escape of pets. This also allows for the free flow of outside air into the garage, thereby solving the problem of overheated garages during the warmer seasons. The secondary security door is provided with an interlocking system. This system allows both doors to automatically be locked together and ride up and down the rails in tandem. This feature allows the door operator to lift the security door by closing the primary door, which will then engage the interlocking system, thus, allowing the doors to move together. Thus the user will not have to manually lift or lower the security door if the primary door is equipped with a power garage door opener. In order to utilize the security door, the user will simply lower both doors, disengage the interlocking system and then raise the primary door. The security door is constructed from panels which are sized to fit a single car width garage door opening. The panels can be connected end to end to double their length and span a two car garage door opening.

20 Claims, 7 Drawing Sheets

TANDEM SECURITY GARAGE DOOR

FIELD OF THE INVENTION

The present invention relates to an improvement in the method of both securing and ventilating garages. More specifically, this invention relates to a security door that operates in tandem with an existing garage door to provide interior ventilation while maintaining security even when the garage door is in the open position.

BACKGROUND OF THE INVENTION

Many people use the space in their garage not only for vehicle parking and storage, but also as additional work or leisure space. During the warmer seasons, the interior of a garage can become unbearably hot even on moderately warm and sunny days, as many garages are not insulated or ventilated. One solution to this problem is to leave the garage door open to allow the air inside the garage to circulate with the cooler, outside air. While this works to ventilate the interior of the garage, it creates a serious problem in home security as the garage area is left vulnerable to entry by anyone passing by. This problem is compounded when the owner is engaged in a project; occasionally the garage door is left open and the garage unattended during interruptions or is simply left open due to forgetfulness.

Additionally, in many home designs where the garage is connected to the living space, with the ease in entry to the garage space, an intruder can also gain entry to the living quarters of the home. This not only puts personal belongings contained in the garage and house at risk, but also increases risk to the owner's personal safety.

In addition to strangers and thieves entering the garage, an open garage door invites other unwanted pests such as animals. These pests can cause discomfort or even danger to the owner and cause destruction to personal items stored in the garage.

Conversely, it is often desirable to prevent escape from the garage. Many owners allow their children or pets to play in the garage when it is used as a recreational area, or have them in the garage area for supervision while the adult is working. In that case, it is desirable in preventing the child or pet from leaving the garage and wandering into the street.

In the past, attempts have been made to solve the problems associated with open garage doors, but previous methods have proven to be cumbersome and expensive. Some homeowners have used a large frame-type apparatus, covered by screen material, which is mounted over the opening of the garage. While this method successfully keeps insects and animals out and allows for air circulation, it has proven to be very impractical when the garage is used for storage and parking of automobiles, as it cannot be easily moved to allow the vehicle ingress and egress from the garage. Additionally, the screen material can easily be cut to allow persons to gain access to the garage.

U.S. Pat. No. 3,126,944 (granted to Kempinski) shows a garage door covering which is stored in a horizontal manner at the upper end of a garage opening. It is engaged by pulling the door cover outward from the garage and rotating it down towards the garage to cover the door. While this apparatus accomplishes its intended purpose of restricting access to the garage, it must be manually engaged. Further this invention will only operate when the existing door is in the upright or open position and must be manually stored prior to lowering or closing the existing garage door.

Other attempts at a solution, such as U.S. Pat. No. 4,081,018 (granted to Szwartz), consists of an awning extending from the front of the garage, which encases a plurality of hinged storm door sections which slide down to cover the garage door. The door sections can be moved upward and stored within the awning when not in use. However, this method requires installation of the awning and door sections to the front of the garage and does not work in conjunction with the existing garage door.

Other types of garage door screen/covers operate with the use of overhead tracks to move the door covering to and from its position over the opening of the garage, often these use a portion the existing rails employed by the standard garage door. U.S. Pat. No. 3,021,896 (granted to Buono et al.) and U.S. Pat. No. 2,072,092 (granted to Blodgett) illustrate the use of separate horizontal guide rail systems for supporting the screen door and standard door when in the overhead position, and a shared vertical guide rail system to hold either the screen door or the standard door when in a closed position. The user can choose either door to cover the garage opening, but only one door can be employed by the vertical rail system at a time, thus eliminating the ability to safely use an automatic door opener to move the screen door.

A solution to this problem has been to add a complete second door track below and behind the standard garage door track. U.S. Pat. No. 5,050,660 (granted to Bleichwehl et al.) shows this type of system. In Bleichwehl et al. a second door track is attached to the existing garage door track. The second door is comprised of several foraminous door panels attached together which ride on the second track. The problem with the system taught by Bleichwehl et al. is that it requires a complicated counter balance system to manage the second door independently from the first and it cannot utilize a standard automatic door opener.

U.S. Pat. No. 3,103,967 (granted to Gaschen) also employs a plurality of hinged interconnected sections which are moved into place by the use of rollers and a rail system. This configuration requires substantial modification of the garage, as the moldings on the jambs and sill of the garage door have to be moved outward to permit vertical tracks to be installed adjacent to the existing garage door tracks. U.S. Pat. No. 5,408,789 (granted to Plfeger) discloses a similar double track system. However, this door is constructed for use in a loading dock and thus, contains safety supports and barriers not applicable to home use. The above described secondary screens and security doors must be independently operated by the user in order to move them into the closed position. Since the garage door and screen door do not move together, a motorized garage door opener affixed to the garage door could not be used to open and close the screen door. Manual operation of such a door would be required.

From the foregoing discussion, it can be seen that it would be desirable to provide a method for covering the opening of a standard garage with an alternate door covering which will prevent ingress and egress from the garage by unwanted persons and animals while allowing for light and air to pass through freely. Additionally, it would be highly desirable to provide a method by which a garage opening could easily be covered and uncovered in conjunction with a standard garage door. Further, it would be desirable to provide a method by which the user could employ a new or existing motorized garage door opener to move the alternative door into the closed position, such that the user would not have to independently open and close the secondary door. The present invention solves these problems and also offers other advantages over the prior art and solves various problems associated therewith.

SUMMARY OF THE INVENTION

It is the primary objective of the present invention to provide a method of securing a garage door opening from unwanted intrusion while still allowing for the free ventilation of the interior space of the garage.

It is an additional objective of the present invention to provide such a method of securing a garage door opening in a manner that can be installed and used in conjunction with an existing garage door system.

It is still a further objective of the present invention to provide a means of securing a garage door which can be opened and closed simultaneously with the standard garage door, especially when a motorized garage door opening system is in use.

It is still a further objective of the present invention to provide an interlocking system that will make it possible for all users to engage or disengage the security door without regard for physical ability.

These objectives are accomplished by the use of a secondary security garage door that is attached to and operates behind the primary garage door. The attachment is accomplished by installing a second garage door rail behind the primary garage door rail upon which the security door rides. The security door is made up of multiple panels composed of an outside frame supporting a heavy wire mesh material. When assembled and installed, these panels form a barrier that prevents unwanted intruders access to the garage and that allows for the free flow of outside air into the garage. Thereby solving the problem of overheated garages during the warmer seasons.

The secondary security door is provided with an interlocking system. This system allows both doors to automatically be locked together and ride up and down the rails in tandem. This features allows the door operator to lift the security door by closing the primary door which will then engage the interlocking system, thus allowing the doors to move together. Thus, a user will not have to manually lift or lower the security door if the primary door is equipped with a power garage door opener. In order to utilize the security door, the user will simply lower both doors, disengage the interlocking system, and then raise the primary door. The interlocking system will make it possible for all users to engage or disengage the security door without regard for physical ability.

For a better understanding of the present invention reference should be made to the drawings and the description in which there are illustrated and described preferred embodiments of the present invention.

DESCRIPTION OF THE PREFERRED EMBODIMENT

Figures 1, 2:
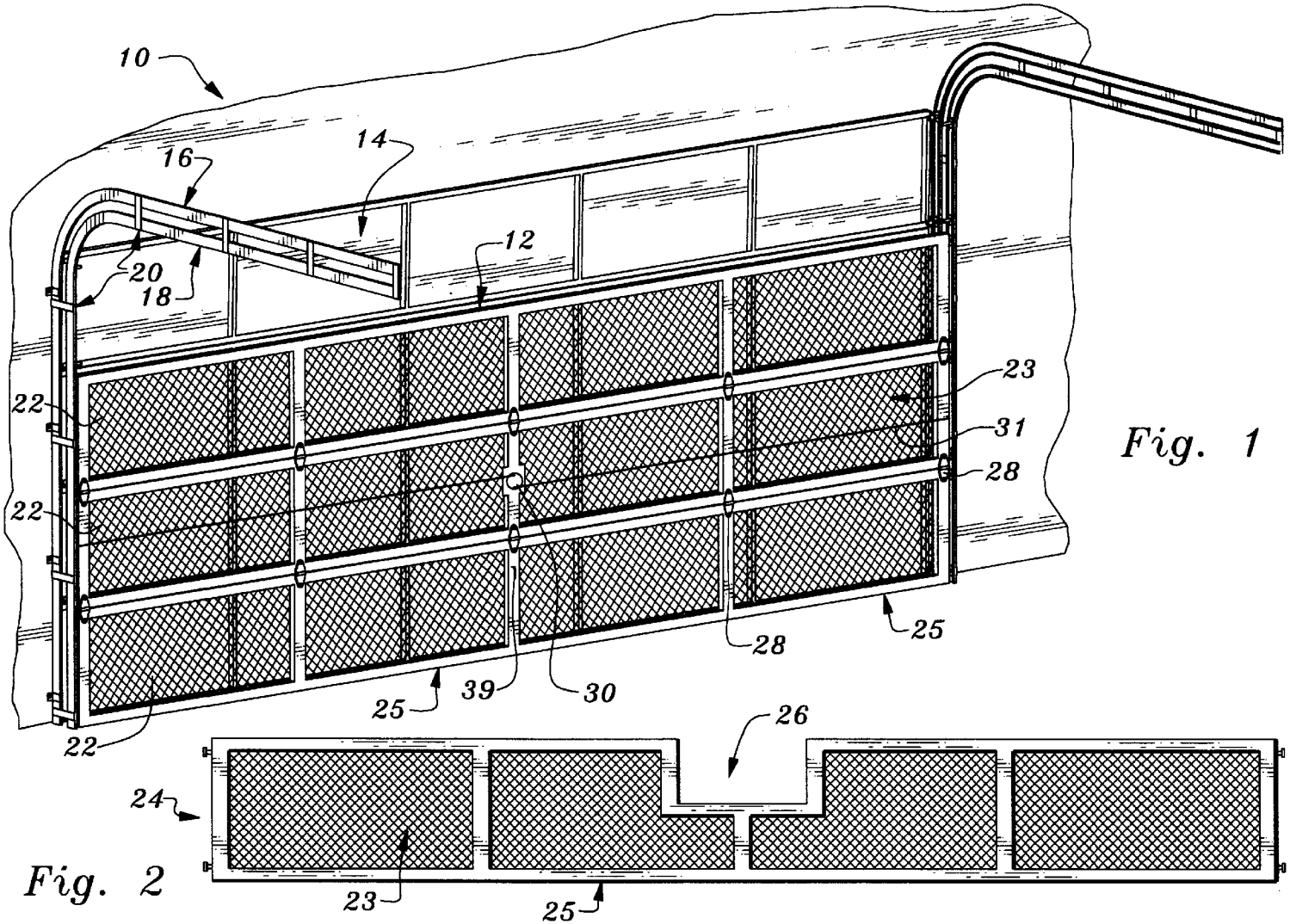
FIG. 1 is a rear perspective view of the present invention showing its major components in relation to the existing garage door and door track system as viewed from the interior of a garage.
FIG. 2 is a front elevation view of an optional security panel which can be attached to the present invention and is configured to accommodate an existing garage door opener motor arm used to connect the primary door and the opener.
Figures 3, 5, 6, 7:
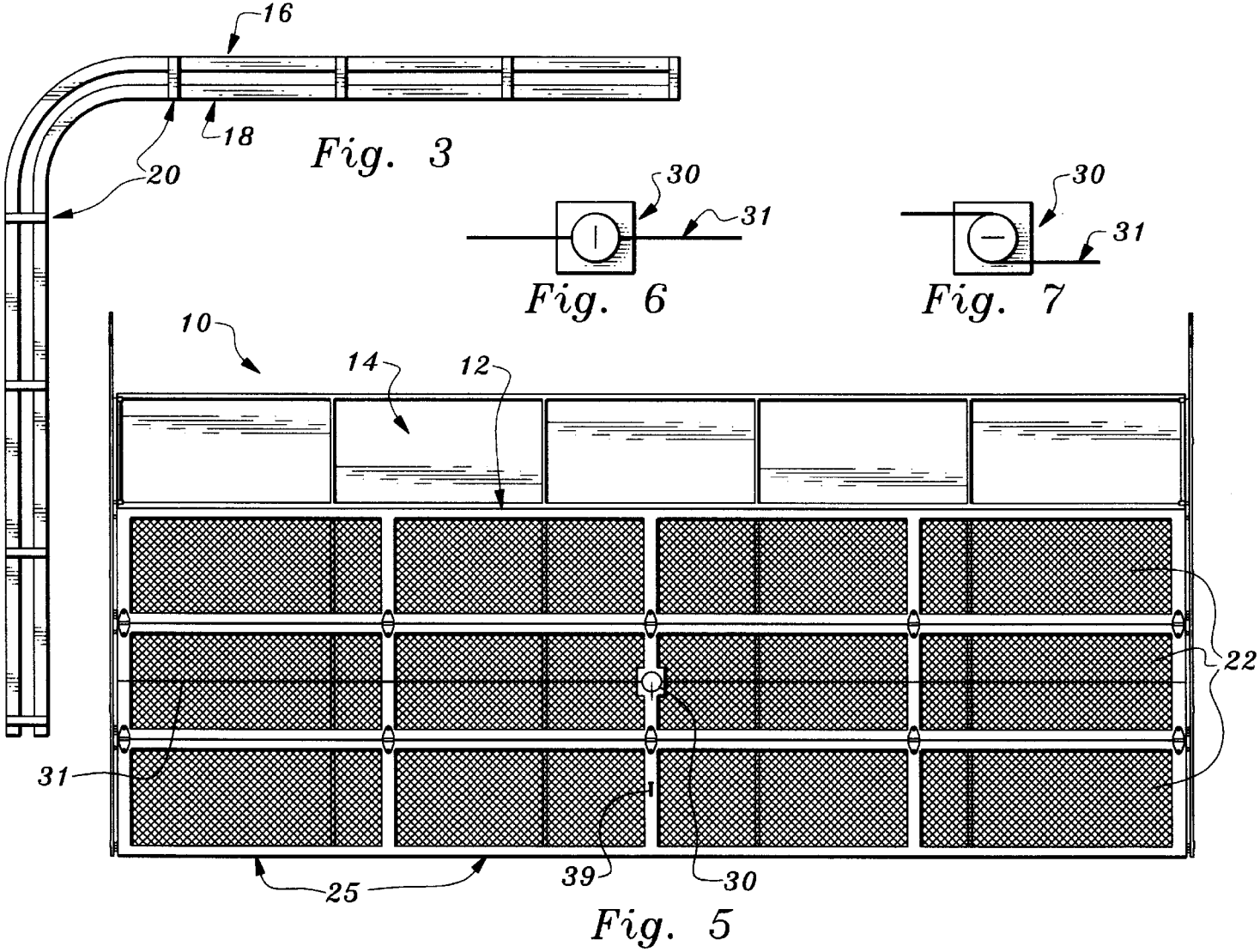
FIG. 3 is a side elevation view of the door track system of the present invention detailing the manner in which the track for the security door is attached to the existing garage door track.
FIG. 5 is a rear elevation view of the present invention showing its major components in relation to the existing garage door which is shown as partially closed to block the open space above the present invention, as viewed from the interior of a garage.
FIG. 6 is a rear elevation view of the locking system of the present invention as shown in the locked position.
FIG. 7 is a rear elevation view of the locking system of the present invention as shown in the open position.
Figure 4:
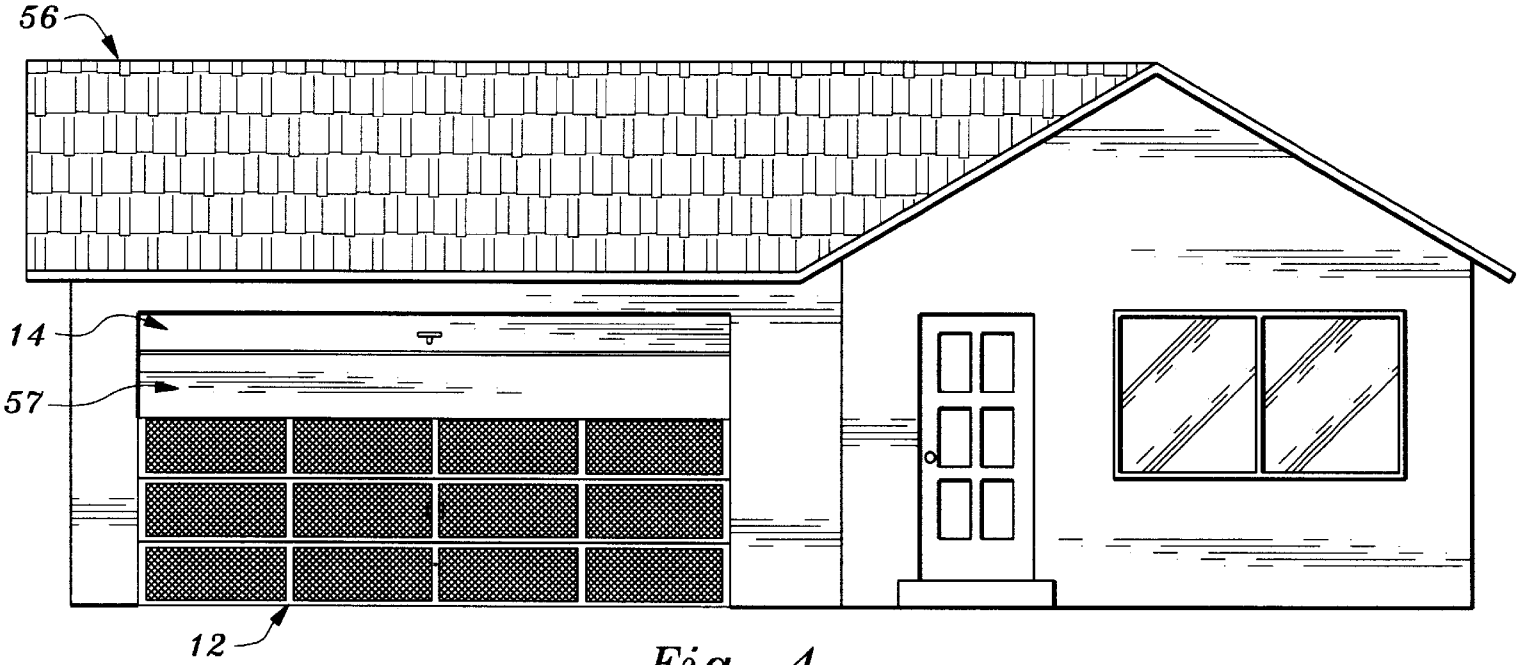
FIG. 4 is a front elevation view of a typical single family house showing the manner in which the security door is used to close off the garage door opening when the existing garage door is in the open position.

Referring now to the drawings, and more specifically to FIGS. 1, 4 and 5, a tandem security garage door system 10 is shown which provides a means by which the interior of a garage 56 can be secured from unwanted intrusion while still allowing for the full ventilation of the interior of said garage 56 space. This is accomplished by the use of a security door 12 which is made up of a plurality of individual security panels 22. These security panels 22 are made up of outside frame members 25 having a formed wire security mesh 23 covering the outside frame members 25, thereby, forming a barrier to intrusion that allows for the free flow of air through the barrier.

The security door 12 is attached to and used with an existing primary garage door 14 by the use of a security door guide rail 18 which is permanently attached behind and beneath the existing garage door rail 16 via fastening straps 20. The security door 12 rides along the security door guide rail 18 in the same fashion as the primary garage door 14. This configuration positions the security door 12 directly behind the primary garage door 14 in relation to the garage 56 and allows it to be raised and lowered with the primary garage door 14 or to be left in the down position independently. Therefore, if the primary garage door 14 is opened, and the security door 12 is left in the down position, the interior space of the garage 56 is secure from unwanted outside intrusion and aids in blocking children and pets from gaining access to the dangers of the outside world.

The security door 12 in its standard configuration does not extend to the top of the garage door opening 57 (FIG. 4). This is because the electric motor arm (not shown) used to open and close the primary garage door 14 extends into the plane of travel of the security door 12 in the up, or raised, position. The fact that the security door 12 does not entirely enclose the garage door opening 57 does not present a security problem, as the opening left by this configuration is relatively narrow and in a position that is difficult to access because of its high position in relation to the ground.

If, however, a user wishes to enclose the entire area of the garage door opening 57, there are two available options which accomplish this. The first of these is to partially close the primary garage door 14 so that it covers this area. This effectively encloses the entire garage door opening 57. The other method is illustrated in FIG. 2 and comprises an additional optional opener accommodation panel 24. This panel 24 attaches to the upper surface of the security door 12 and is constructed in much the same manner as the other security panels 22, with the exception that at its center upper surface there is an opener notch 26 that extends inward into the opener accommodation panel 24. The opener notch 26 allows the security door 12 to fully open and close without interference from the opener motor arm (not shown) and when the security door 12 is in the down position, allows the entire garage door opening 57 (less the opener notch 26) to be covered by the security door 12.

Figure 8:
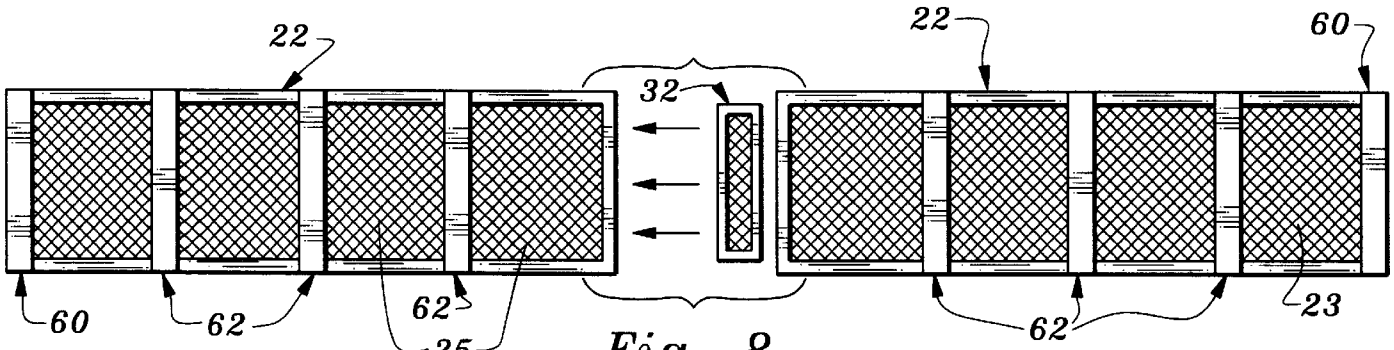
FIG. 8 is a rear elevation view of the panels of the present invention showing the manner by which said panels can be shortened or expanded in order to accommodate garage door openings of varying widths.
Figure 9:
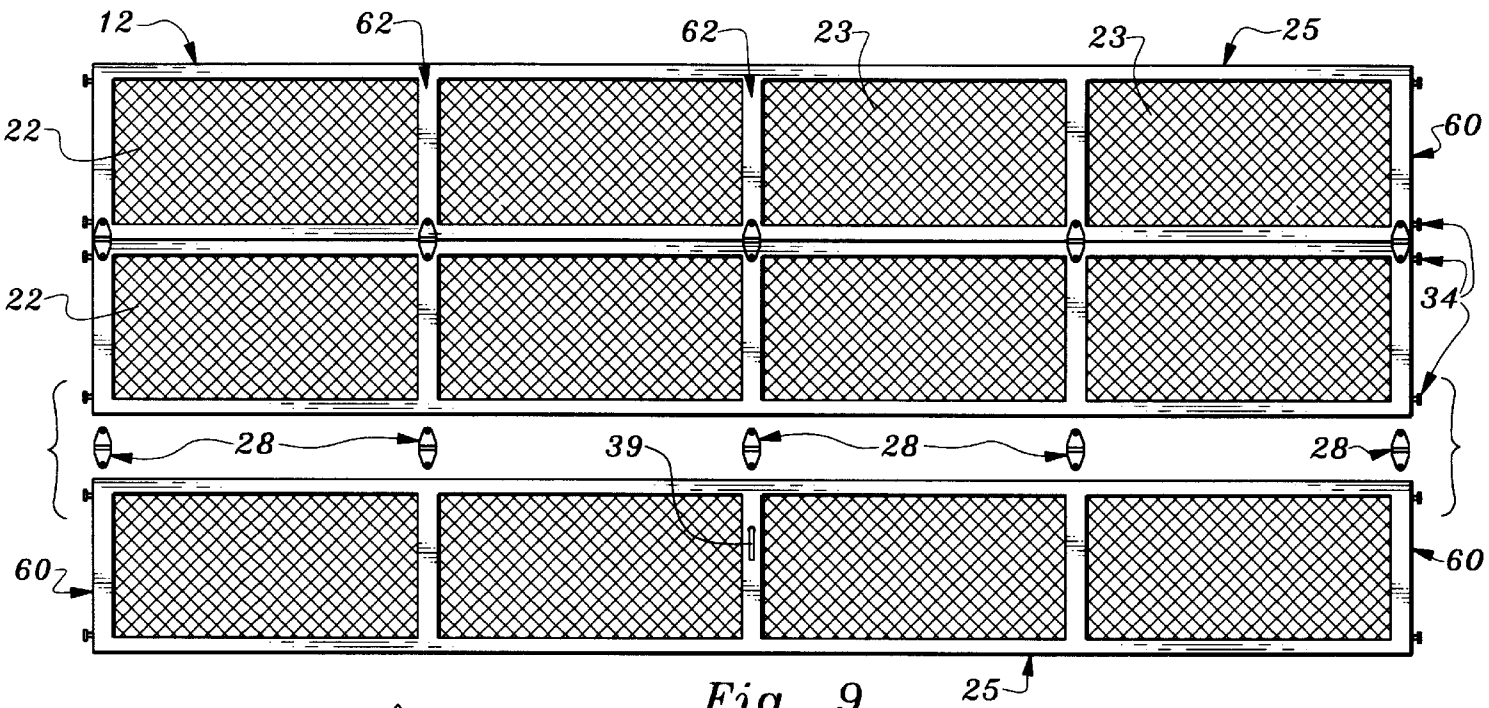
FIG. 9 is a rear elevation view of the security panel of the present invention showing the manner in which the individual horizontal panels are pivotally attached to accommodate the bend in the track as the door is opened and closed.
Figure 17:
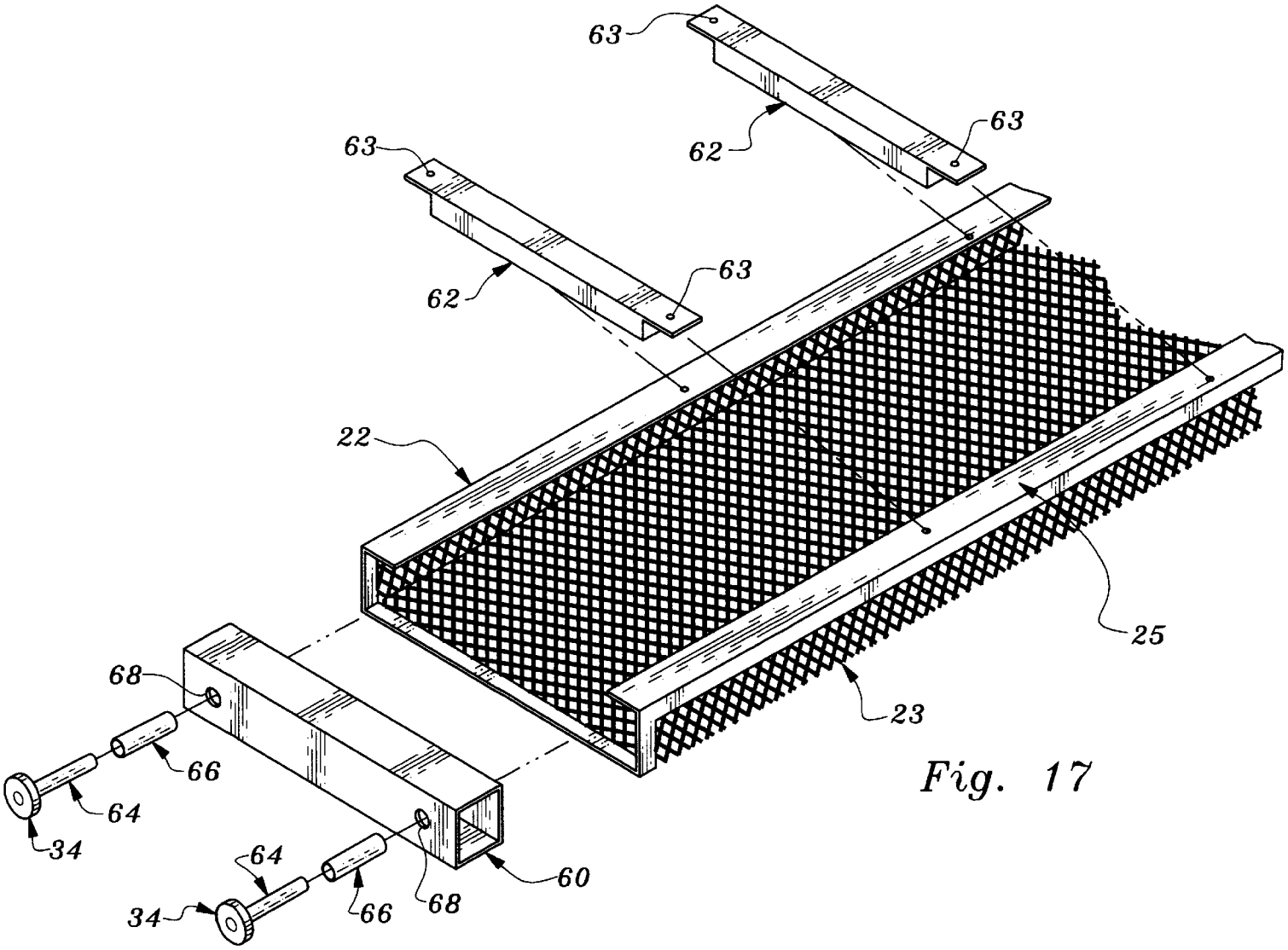
FIG. 17 is an exploded perspective view of an individual security panel of the present invention detailing the manner of construction of said panel.

The method of construction, of the security door 12 of the present invention is detailed in FIGS. 8, 9 and 17. As previously discussed, the security door 12 is made up of individual security panels 22 which are attached together to form the security door 12. The individual security panels 22 are constructed by the use of two parallel outside frame members 25 which provide the structure over which the wire security mesh 23 is formed to make a security panel 22. The parallel outside frame members 25 are intermittently spanned by a frame cross-member 62 fastened to the outside frame member 25 at the cross-member attachment point 63. The frame cross-members 62 add longitudinal structural integrity to the security panels 22.

The ends of the panels 22 are capped by the end frame members 60, which also provide the attachment points for the door rail wheel assemblies 34. The attachment of the door rail wheel assemblies 34 is accomplished by the use of the door rail wheel roller bushings 66, which fit into the door rail wheel roller guide holes 68, which are drilled into the sides of the end frame members 60. Additionally, the wheel assemblies 34 have extending reward door rail wheel pins 64 which fit into the door rail wheel roller bushings 66, thereby attaching the wheel assemblies 34 to the security panel 22.

The individual security panels 22 are connected together to form the security door 12 by the use of a plurality of hinged panel connectors 28, which are two eared hinges with one of the ears being attached to the inner upper edge of a security panel 22 and the other being attached to the inner lower edge of a subsequent security panel 22. This attachment is repeated along the length of the security panels 22 along the surface of the outside frame members 25. In this manner the individual security panels 22 are "stacked" to form the security door 12, thus, enabling a garage door opening 57 to be secured.

As shown by FIG. 8, the individual security panels 22 are also adjustable in their length by the use of the horizontal frame connectors 32. This device fits between two security panels 22 to increase the length of the panel or to allow the panels to be connected at varying points. This allows a security door 12 to be adjusted to accommodate garage door openings 57 of differing sizes. The most prevalent use for this design feature of the present invention is that it can be adapted for use with a garage having single or double doors without the need for major alterations to either the invention or the garage 56. Additionally, the panels 22 can be provided with a lesser length (i.e. 8 feet) and still span a multi-car garage door opening 57 (i.e. 16 feet). Shorter panels 22 can be more readily transported in smaller vehicles such as in pick-up truck beds.

The security door 12 also comes equipped with a locking device 30 which allows it to be locked in the down position and is illustrated in FIGS. 1,6 and 7. This device works in the same manner that a typical garage door lock does, in that it is primarily a locking rotating cylinder having attached to it two locking cables 31 or rigid rods that extend to either side of the security door 12. Each locking cable 31 is attached at its outside end to a spring loaded locking pin that, in the locked position, engages the security door guide rail 18 and locks the security door 12. As the locking device 30 is rotated, the pins or rods are retracted leaving the security door 12 free to be opened.

Figure 11:
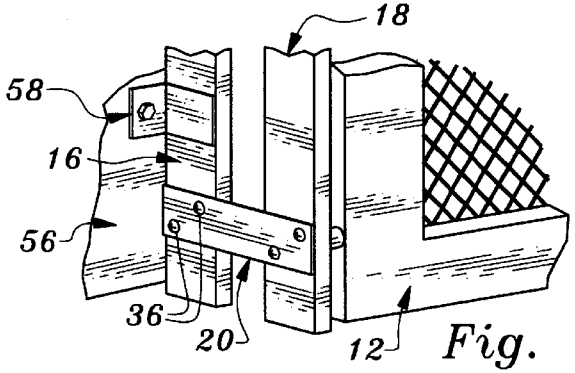
FIG. 11 is a perspective view of the track system of the present invention detailing how the security door track is attached to the existing garage door track.
Figure 10:
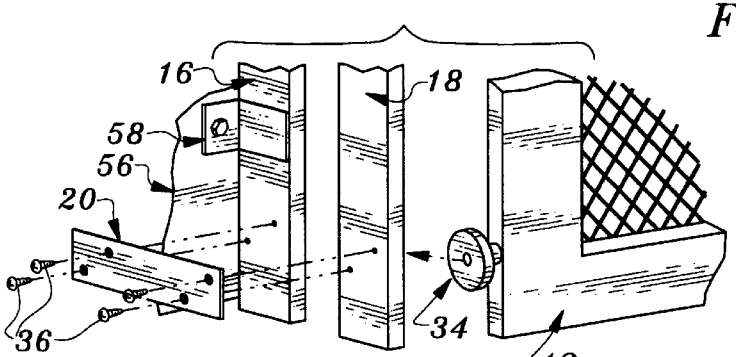
FIG. 10 is an exploded perspective view of the track system of the present invention detailing the manner in which the security door track is attached to the existing garage door track and how the security track wheels fit inside of said security track.
Figure 12:
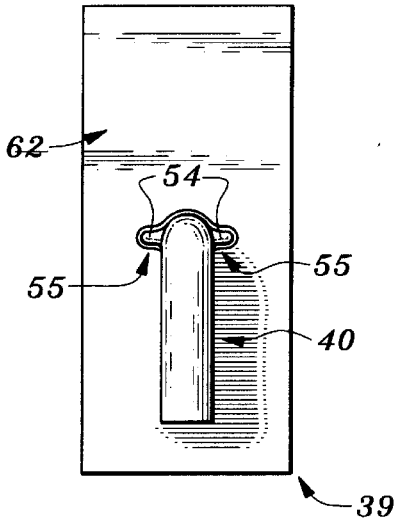
FIG. 12 is a rear elevation view of a system for selectively interlocking the security door to the garage door and detailing the configuration of the interlocking rod in relation to a panel of the security door to which it is mounted.
Figure 13:
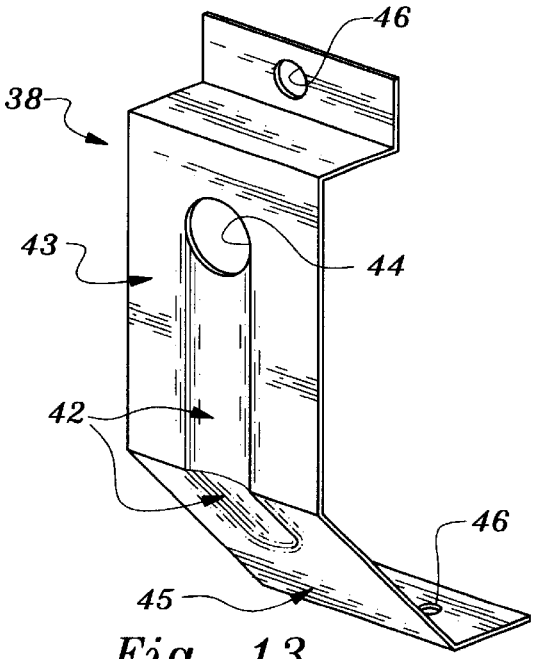
FIG. 13 is a perspective view of the interlocking device of the interlocking system that is mounted to the garage door detailing its configuration.
Figure 14:
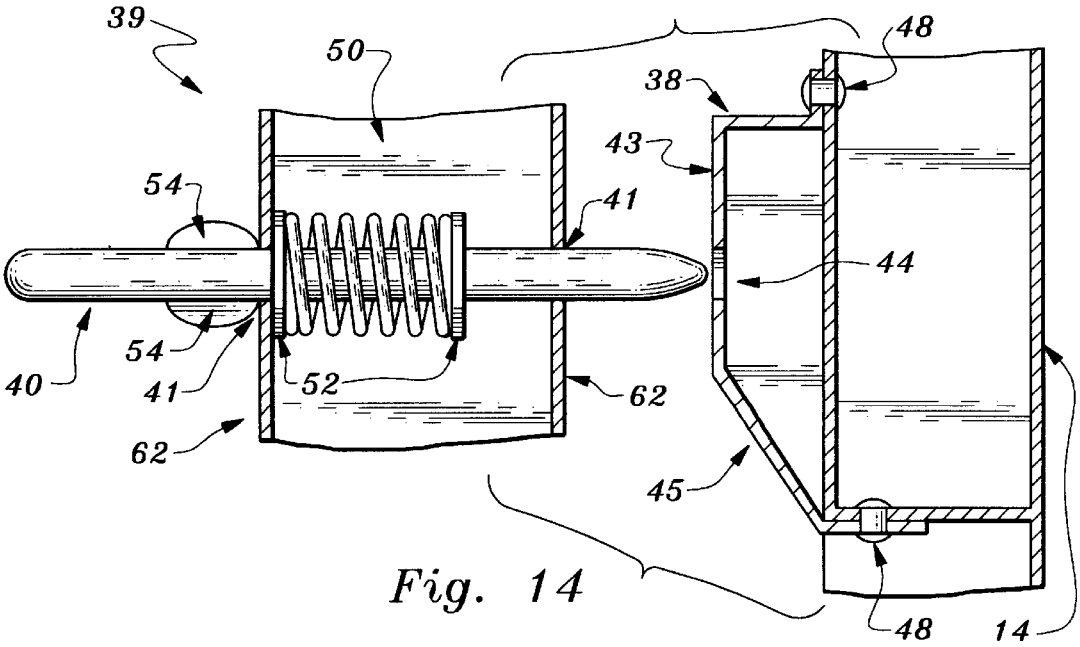
FIG. 14 is a side elevation cut-away view of the interlocking device and the pin of the interlocking system in the locked open position of the present invention showing their orientation to one another and their relation to the security door and existing garage door.

The manner in which the security door guide rails 18 are attached to the primary garage door guide rails 16, and the manner in which the door rail wheel assembly 34 attaches to the security door guide rail 18 are illustrated in FIGS. 3, 10 and 11. As previously described, the security door guide rails 18 are attached behind, on their vertical portion, and underneath, on their horizontal portion, the garage door guide rails 16 which are in turn fastened to the garage 56 by the primary door attachment hardware 58. The attachment of the security guide rails 18 is accomplished by the use of a plurality of fastening straps 20 which are attached by the use of the fastening strap attachment bolts 36 or other suitable fasteners at one end to the garage door guide rails 16, and on the other to the security door guide rails 18. Additionally, the fastening straps 20 are long enough so that this method of attachment provides a gap between the garage door guide rails 16, and the security door guide rails 18 which allow the doors the required space to operate effectively both in tandem and independently.

The security door 12 is attached to the security door guide rails 18 through the door rail wheel assembly 34. The wheel assembly 34 extends outward from the security door 12 and each individual wheel 34 fits inside of the internal groove formed on the inwardly facing surface of the security door guide rail 18. This configuration allows the wheel assemblies to roll freely within and along the extent of the security door guide rails 18, and also secures the security door 12 in the desired position inside of the garage door 14.

The manner of construction of the interlocking system 39 which facilitates the attachment of the security door 12 to the garage door 14 during opening and closing procedures, is detailed in FIGS. 12–16. The attachment is accomplished by the interlocking pin 40 which passes through a central one of the security panel cross members 62 by means of the interlocking pin guide hole 41 adjacently located on opposite sides of said cross member 62. Alternatively, the interlocking pin may be placed outside the frame 25. It is important to note this location is representative of function only and not position. The interlocking pin 40, on its outward end, is equipped with an interlocking pin flange 54 which, when in the horizontal position, passes through the interlocking pin hole groove 55, a horizontal extension of the interlocking pin guide hole 41. This allows the interlocking pin to extend through the security panel end frame member 60 to engage the garage door 14. Conversely, if the interlocking pin flange 54 is placed in the vertical position it cannot pass through the interlocking pin notch groove 55 and, therefore, the interlocking pin cannot extend far enough through the security panel 18 and cross member 62 to engage the garage door 14.

The interlocking pin 40 is equipped with a pin spring 50 which provides pressure on the locking pin 40 in a manner that tends to force it towards the garage door 14. The pin spring 50 encircles the interlocking pin 40 and is located in the interior of the cross member 62. At its most inward end, or that closest to the garage door 14, and at its most outward end, or that furthest from the garage door 14, the pin spring is encased by the pin spring retainer washers 52. The inward pin spring retainer washer 52 is permanently attached to the interlocking pin 40, which limits the travel of the pin spring 50 in relation to the interlocking pin 40. This configuration has the effect of counteracting any outward force placed on the interlocking pin 40, therefore, the natural position of the interlocking pin 40 is extended to the point at which it can engage the garage door 14.

The extended interlocking pin 40 engages the garage door 14 by the use of the interlocking device 38, which is a bracket attached to the lower edge of the garage door 14. This attachment is accomplished by fixing rivets 48, or other suitable fasteners, through the interlocking device attachment holes 46 located in both the interlocking device 38 and the garage door 14. The interlocking device 38 has an extended vertical surface 43 that parallels the surface of the garage door 14, and contains the interlocking pin hole 44. It is the interlocking pin hole 44 that provides the point at which the interlocking pin 40 engages and locks the security door 12 to the garage door 14.

The interlocking device 38 also has a diagonal surface 45 which extends from the lower end of the vertical surface 43 to the bottom of the garage door 14. The diagonal surface has the lower portion of the pin guide groove 42 which extends up into the vertical surface 43 to the lowest point of the interlocking pin hole 44. The pin guide groove 42 serves to capture and guide the interlocking pin 40 into the interlocking pin hole 44.

Figure 15:
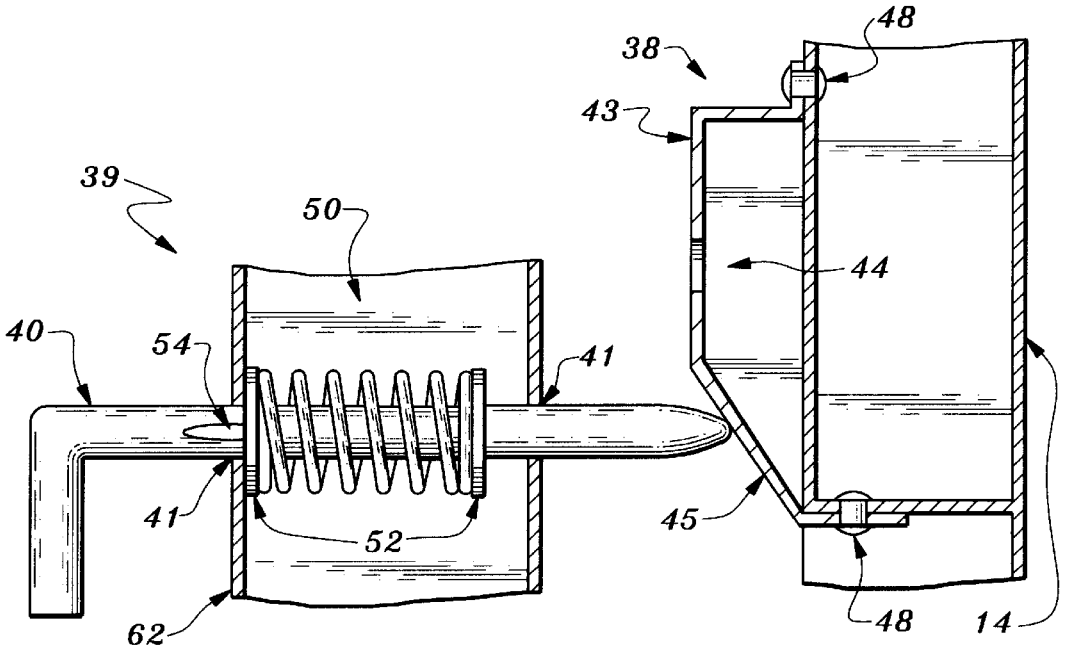
FIG. 15 is a side elevation cut-away view of the interlocking device and pin of the interlocking system showing the interlocking pin in the closed position as it initially engages the guide groove of the interlocking device mounted to the garage door.
Figure 16:
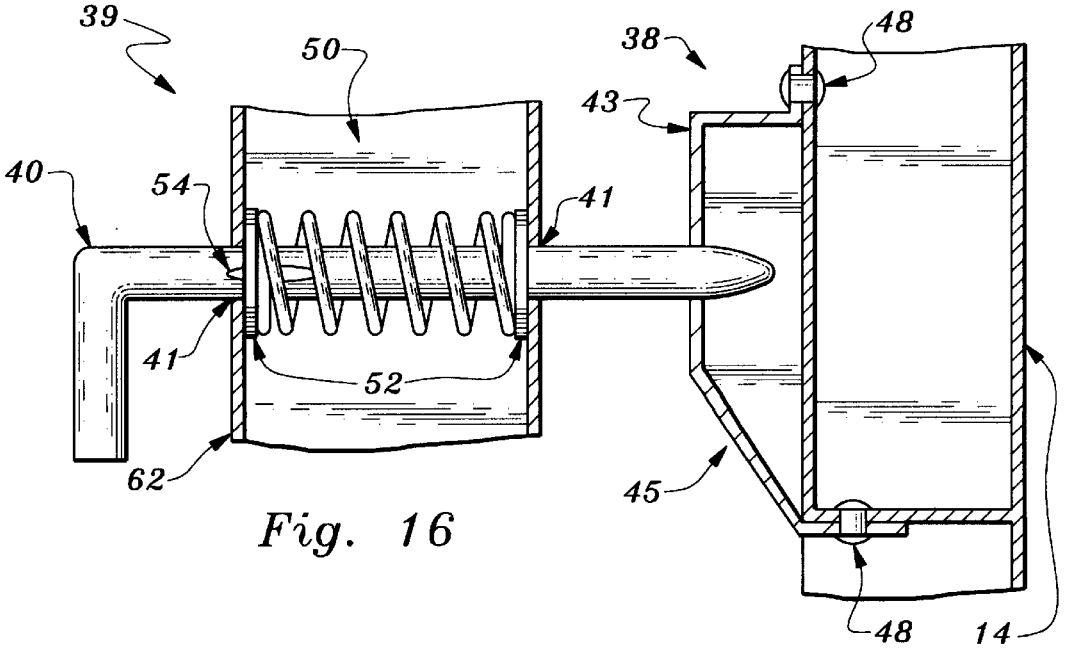
FIG. 16 is a side elevation cut-away view of the interlocking device and pin of the interlocking system showing the interlocking pin fully engaged within the interlocking device, effectively interlocking the security door with the existing garage door.

The manner in which the afore described components of the present invention work to connect the security door 12 to the garage door 14 is illustrated in FIGS. 15 and 16. When the security door 12 is in the down position the user sets the interlocking pin 40 such that the interlocking pin flange 54 is in the horizontal position which allows said flange to pass through the interlocking pin hole groove 55. Thus, allowing the interlocking pin 40 to extend to its furthest point towards the garage door 14. As the garage door 14 is lowered, the interlocking device 38 located at the lowest edge of the garage door 14 begins to engage the interlocking pin 40 extending from the security door 12.

When the interlocking pin 40 makes contact with the interlocking device 38, it does so on the lower portion of the pin guide groove 42 located on the lower portion of the device diagonal surface 45. As the garage door 14 continues its downward motion, the device diagonal surface 45 begins to force the interlocking pin 40 inward against the interlocking pin spring 50. This occurs because the distance between the diagonal surface 45, and the security door 12 decreases as the garage door 14 moves down. The interlocking pin 40 is guided along the diagonal surface 45 by the pin guide groove 42 which is a concave indention on the surface of the interlocking device 38. The opposing pressure created on the interlocking pin 40, by the interlocking pin spring 50, keeps the pin 40 within the concave structure of the pin guide groove 42.

The pin guide groove 42 continues upward from the diagonal surface 45 to the vertical surface 43, where it extends up to the lower portion of the interlocking pin hole 44. Therefore, the interlocking pin 40 is forced to follow the guide groove 42 as the garage door 14 continues its downward motion to the point where it engages the interlocking pin hole 44. At this point the pressure applied to the interlocking pin 40, by the interlocking spring 50, forces it into the interlocking pin hole 44 which effectively locks the security door 12 to the garage door 14.

In this configuration the security door 12 will ride in tandem with the garage door 14 as it is raised and lowered allowing the user to position it as desired. Conversely, if the user wishes to disengage the security door 12 from the garage door 12, he simply pulls the interlocking pin 40 out and rotates it so that the interlocking pin notch 54 is in its vertical position, which keeps said pin from engaging the interlocking device 38. This allows the security door 12 and the garage door 14 to be operated independently making it possible to lock the security door 12 in the closed position while opening the garage door 14. Thus, the desired ventilation is provided to the interior of the garage 56 without compromising the security of the household.

Moreover, having thus described the invention is should be apparent that various modifications to this invention could be resorted to without departing from the scope of this invention. This detailed description of the preferred embodiments of this invention is provided to enable one skilled in the art to practice this invention and to disclose a best mode for practicing this invention but is not intended to limit in any way the scope of the claims to this invention.

What is claimed is:

1. A security garage door system for covering a garage door opening in combination with a standard primary garage door having an inward side, an outward side and a track having an upper horizontal portion and a lower vertical portion for the primary door to travel up to an open position and down to a closed position, said garage door security system comprising:

a security door made of a material permeable to light and air;

a security door track whereby said security door can move between an open and closed position;

an interlocking device fixably attached to the primary door; and an interlocking means connected to said security door for selectably engaging said interlocking device so that when said interlocking means is engaged with said interlocking device said security door and the primary door must move in tandem.

2. The security garage door system of claim 1 wherein said interlocking means comprises:

a pin slidable perpendicular to said security door and biased towards the primary door;

a flange on said pin so that it may be selectably locked in a position so as not to engage said interlocking device, thereby allowing said security door and said primary door to move independently.

3. The security garage door system of claim 2 wherein said security door track has a horizontal portion fixedly connected below the primary garage door track horizontal portion and a security door track vertical portion fixedly connected behind the primary garage door track lower vertical portion.

4. The security garage door system of claim 3 wherein said security door material is metal having a plurality of openings.

5. The security garage door system of claim 4 wherein said security door comprises at least two panels said panels together having a height less than a height of the garage door opening, whereby when said security door is in said closed position the upper portion of the garage door opening is left uncovered.

6. The security garage door system of claim 4 further comprising an upper opener arm accommodation panel having an upper edge and a lower edge said panel including an opening centered on said upper edge of said panel.

7. A security garage door system for covering a garage door opening in combination with an existing standard primary garage door having a track with an upper horizontal portion and a lower vertical portion for the primary door to travel up to an open position and down to a closed position, said garage door security system comprising:

a security garage door having at least two elongate horizontally extending panels hingedly coupled together vertically;

each said horizontal panel formed from at least two interconnecting laterally spaced panels of similar length made of a material permeable to light and air, each said laterally spaced panel having a length similar to one half of a width of the garage door opening; and;

a security door track whereby said security door may move between an open and closed position.

8. The security garage door system of claim 7 wherein said laterally spaced panels are adjustably interconnected with a panel connector plate to form said horizontally extending panels with a width similar to a width of the garage door opening.

9. The security garage door system of claim 8 wherein said system includes:

an interlocking device fixedly attached to said primary door;

an interlocking portion connected to said security door for selectably engaging said interlocking device; and said interlocking portion further includes a pin slidable perpendicular to said security door and biased towards said primary door flanges on said pin so that it may be selectably locked in a position so as not to engage said interlocking device, thereby allowing said security door and said primary door to move independently.

10. The security garage door system of claim 9 wherein said security door track has a horizontal portion fixedly connected below said primary garage door track horizontal portion and a security door track vertical portion fixedly connected behind said primary garage door track lower vertical portion.

11. The security garage door system of claim 10 wherein said material is metal having a plurality of openings.

12. The security garage door system of claim 11 wherein said security door includes an uncovered upper portion of the garage door opening when in said closed position.

13. The security garage door system of claim 11 further comprising an upper opener arm accommodation panel having an upper edge and a lower edge said panel including an opening centered on said upper edge of said panel.

14. A security garage door system for covering a garage door opening in combination with an existing standard primary garage door having a track with an upper horizontal portion and a lower vertical portion for the primary door to travel up to an open position and down to a closed position, said garage door security system comprising:

a security garage door having at least two horizontal panels;

said horizontal panels having outer ends with said horizontal panels formed from at least two interconnecting lateral panels adjustably connected with a panel connector plate said lateral panels formed of a material permeable to light and air;

a plurality of panel cross members fixedly attached vertically across said horizontal panels;

an end frame member connected to said outer ends of said horizontal panels; and a security door track whereby said security door may move between an open and closed position.

15. The security garage door system of claim 14 wherein said security door track has a horizontal portion fixedly connected below said primary garage door track horizontal portion and a security door track vertical portion fixedly connected behind said primary garage door track lower vertical portion.

16. The security garage door system of claim 15 wherein said security door track is connected to the primary garage door track and remains parallel to the primary garage door track.

17. The security garage door system of claim 14 wherein said system includes an interlocking system for interlocking said security garage door to the primary garage door, said interlocking system including an interlocking device affixed to the primary garage door and a means to selectively engage said interlocking device affixed to said security garage door, said selective engagement means aligned with said interlocking device when both said security garage door and the primary garage door are lowered in a position blocking the garage door opening.

18. The security garage door system of claim 17 wherein said interlocking device includes a bracket with a hole therein facing said security garage door and said selective attachment means of said security garage door; and wherein said selective attachment means includes an interlocking pin sized to fit within said hole in said interlocking device.

19. The security garage door system of claim 18 wherein said interlocking pin is oriented horizontally and passes through said security garage door at an interlocking pin hole in said security garage door, said interlocking pin including means to be biassed toward the primary garage door and means to retain said interlocking pin in a position spaced away from the primary garage door.

20. The security garage door system of claim 19 wherein said interlocking pin biassing means includes a spring attached to an surrounding said interlocking pin and fixed on one end to said security garage door and wherein said interlocking pin restraining means includes flanges on said interlocking pin and grooves on sides of said hole in said security garage door through which said interlocking pin is located, said flanges sized to pass through said groove when said flanges are aligned with said groove and said flanges preventing said interlocking pin from moving toward the primary garage door when said flanges are rotated out of alignment with said groove.

* * * * *